US006006552A

United States Patent [19]

Matsuda et al.

[11] Patent Number: 6,006,552

[45] Date of Patent: Dec. 28, 1999

[54] KNITTED SLIDE FASTENER

[75] Inventors: Yoshio Matsuda; Hidenobu Kato; Yoshito Ikeguchi, all of Toyama-ken, Japan

[73] Assignee: YKK Corporation, Tokyo, Japan

[21] Appl. No.: 09/215,311

[22] Filed: Dec. 18, 1998

[30] Foreign Application Priority Data

Dec. 26, 1997 [JP] Japan ..... 9-359028

[51] Int. Cl.[6] ..... D04B 21/20; D04B 21/14

[52] U.S. Cl. ..... 66/193; 66/190; 66/192; 66/195; 66/202; 24/392; 24/398

[58] Field of Search ..... 66/169 R, 170, 66/171, 177 R, 190, 192, 193, 195, 202; 24/391, 397, 393, 398

[56] References Cited

U.S. PATENT DOCUMENTS

| | | | |
|---|---|---|---|
| 4,502,302 | 3/1985 | Matsuda | 66/193 |
| 5,502,985 | 4/1996 | Matsuda et al. | 66/193 |
| 5,502,986 | 4/1996 | Matsuda et al. | 66/193 |
| 5,540,064 | 7/1996 | Matsuda et al. | 66/193 |
| 5,615,563 | 4/1997 | Matsuda et al. | 66/193 |
| 5,685,177 | 11/1997 | Matsuda et al. | 66/193 |
| 5,802,883 | 9/1998 | Matsuda et al. | 66/193 |
| 5,857,359 | 1/1999 | Matsuda et al. | 66/193 |

*Primary Examiner*—John J. Calvert
*Assistant Examiner*—Larry D. Worrell, Jr.
*Attorney, Agent, or Firm*—Hill & Simpson

[57] ABSTRACT

The present invention provides a warp-knit slide fastener in which a fastener element row can be easily knitted into and attached stably and firmly on a fastener tape, and fastener elements of the fastener element row are not separated from each other due to pushing up of a fastener face.

The successive fastener element row is knitted, simultaneously with knitting of the fastener tape, into a fastener element attaching portion at longitudinally side edge portion of the fastener tape, and is fixed by two wales or more of fixing chain stitch yarns. Respective needle loops of the respective fixing chain stitch yarns push respective element leg portions of the successive fastener element row from above toward a foundation structure. Respective sinker loop groups form a part of the foundation structure on which the successive fastener element line is disposed. Warp in-laid yarns are warp inserted through at least a part of sinker loops of the sinker loop groups while being intermingled. Heat contraction rates of all yarns forming the fastener element attaching portion are higher than that of yarns forming a fastener tape main body portion. After knitting, respective knitting yarns are heat contracted.

5 Claims, 11 Drawing Sheets

KNITTED SLIDE FASTENER

BACKGROUND OF THE INVENTION

1. Field of the Invention

The present invention relates to a knitted slide fastener comprising a fastener tape formed by a warp knitting structure and a successive fastener element row being simultaneously knitted into an element attaching portion of a longitudinally side edge portion of the fastener tape, and specifically, to a knitted slide fastener comprising the successive fastener element row firmly attached to the element attaching portion having a fine knitting structure, wherein there is no irregularity of pitches between or separation of elements of the element row, and stability in a shape of the fastener element attaching portion of the fastener tape is ensured.

2. Description of the Related Art

Conventionally, as a knitted slide fastener of the type in which a continuous fastener element row is knitted simultaneously with knitting of a fastener tape, there is a known knitted slide fastener as disclosed in U.S. Pat. No. 3,864,945 and Japanese Patent Laid-open Publication No. 2-255104, for example, in which a continuous fastener element row made of plastic monofilament is mounted and fixed by being knitted into stitches of a plurality of fixing chain stitch yarns simultaneously with knitting of the fastener tape. However, in the knitted slide fastener disclosed in the above U.S. patent, because each element of the successive fastener element row is fixed merely by a sinker loop of each fixing chain stitch yarn which extends across an upper face of a leg portion of each the fastener element, and because the foundation structure of the attaching portion is formed by needle loops of the chain stitch yarns and weft in-laid yarns, a fixing force is weak in conjunction with its stretch peculiar to the stitches of the chain stitch. In the knitted slide fastener disclosed in the latter Publication, because the leg portion of each fastener element of the fastener element row are fixed by sinker loop of each fixing chain stitch yarn and the foundation structure at the fastener element attaching portion is consisted of needle loops of the fixing chain stitch yarn and weft in-laid yarns, fixing force of the fastener element row is weak, and the fixing side structure becomes quite coarse, so that a coupled portion of the fastener element rows coupled with each other rises, which is liable to cause separation of the fastener elements from each other, especially when a fastener face receives a pushing up bending stress as shown in FIG. 11. In order to avoid the problem, the fixing knitting yarns can be thicker than other knitting yarns to firmly fix the fastener element row, but distances between knitting needles of a normal warp knitting machine are very small and the knitting needles are required to be fine in order to increase the distances. Therefore, a thickness of the knitting yarns and a number of knitting yarns to be twisted around the knitting needle are naturally limited.

There is a knitted slide fastener developed to solve the above problems as disclosed in Japanese Patent Laid-open Publication No. 8-314, for example. In the knitted slide fastener disclosed in this Publication, another chain stitch yarn is added to a needle loop group constituting a wale on a tape foundation structure side formed by chain stitch threads for fixing the fastener element row. Because of the above chain stitch knitted by overlapping stitches of the foundation structure at the attaching portion of the fastener element row, the attaching portion is made fine, and fixing of the fastener element line is stabilized.

However, in the above knitted slide fastener disclosed in Japanese Patent Laid-open Publication No. 8-314, a knitting yarn for holding the fastener element row from above on a side opposite from the tape foundation structure side still is only sinker loops of the fixing chain stitch yarns. As a result, knitting structures disposed on and under the fastener element row are unbalanced, and a structure on the upper side of the fastener element row is weak. In this case, when the fastener face receives the pushing up bending stress, separation of the fastener elements from each other is liable to be caused. Furthermore, knitting with another chain stitch thread overlapping as disclosed in the above Japanese Patent Laidopen Publication so as to stabilize the stitches themselves of the fixing chain stitch would result that three knitting threads including a thread for tricot stitches are twisted around a knitting needle, thus a strain is put on the knitting needle.

SUMMARY OF THE INVENTION

It is an object of the invention to provide a knitted slide fastener wherein the above conventional problems are solved, knitting of fastener element row is easy, a knitting structure with a high density can be obtained at an attaching portion of a fastener element row in a fastener tape by a normal warp knitting machine, the fastener element row can be attached firmly and stably in size, and an appropriate resisting force can be applied to the fastener against pushing up of a fastener face such that the fastener element rows are not separated from each other due to bending of the fastener in use.

To achieve the above object, according to the present invention, there is provided a knitted slide fastener including a successive fastener element row fixed by at least a wale of fixing knitting yarn, the fastener element row being knitted, simultaneously with knitting of a fastener tape, into a fastener element attaching portion at a longitudinal side edge portion of the fastener tape formed of a warp-knit foundation structure, wherein the foundation structure of the fastener element attaching portion is formed of at least a part of the fixing knitting yarns and other knitting yarns, and all of the knitting yarns forming the fastener element attaching portion have heat contraction rates higher than at least that of knitting yarns forming a foundation structure of a fastener tape main body portion.

In this slide fastener, by setting a relationship between respective heat contraction rates of yarns forming the fastener element attaching portion and the fastener tape main body portion and the fastener element row in the above manner, the yarns forming the fastener element attaching portion contract more largely than the yarns forming the fastener tape main body portion through a heat treatment after knitting, even in a case where a knitting density is set at a normal value, thereby increasing a density of the fastener element attaching portion and making the portion fine. Thus, a shape of the fastener element attaching portion is further stabilized in addition to that a touch and appearance of fabric can be given to the portion by the above knitting structure. Furthermore, because the fastener element row is firmly strained and fastened by the fixing chain stitch yarns, the elements are not separated from each other when the fastener stringer is strongly bent toward a tape face, thereby ensuring a high coupling strength.

Moreover, the above structure has a function to straighten the completed fastener stringer. In other words, in the knitted slide fastener having the successive knitted fastener elements, predetermined tension is usually applied to each the knitting yarn during knitting. Therefore, each the yarn can be knitted finely, but the element attaching portion can not be knitted finely because of the elements. Thus, a knitted product curves in a bow shape as a whole, wherein the element row curves to project outward. In the present invention, if a dry heat treatment or a boiling water treatment is applied to the knitted product of the above shape, because the heat contraction rate of the element attaching portion is larger than that of the fastener tape body, the entire fastener stringer becomes substantially straight or the element row slightly curves to project inward, thereby facilitating succeeding operations such as sewing of the completed slide fastener.

Preferably, as the heat contraction rates of all the knitting yarns forming the fastener element attaching portion are set to be higher than that of the fastener element row, the shape of the fastener stringer is further stabilized and the fixing knitting yarns bite into and form recessed grooves in strained and fastened portions of the fastener element row as a result of contraction of the yarns forming the fastener element attaching portion and especially, contraction of the fixing knitting yarns. Therefore, a straining and fastening force for the fastener elements are further increased and displacement of the fastener element row in a longitudinal direction and a width direction is prevented.

Preferably, a heat contraction rate of a warp in-laid yarn which constitutes the fastener element attaching portion is higher than that of the other yarns forming the fastener element attaching portion. Thus, the shape of the fastener stringer is further stabilized. Also, due to contraction of the fixing chain stitch yarns as well as contraction of the monofilament which constituting the fastener elements, leg portions of the fastener element row are strained and fastened by the fixing chain stitch yarns and partially deformed to have recessed grooves. Therefore, the straining and fastening force is increased and simultaneously, the fastener element row is not displaced in the longitudinal direction or the width direction.

It is preferable that the fastener element row is made of thermoplastic synthetic resin, the heat contraction rate of the monofilament which is a material forming the fastener element row is in a range of 3 to 18%, a dry heat contraction rate of the warp in-laid yarn which forms the fastener tape is in a range of 15 to 40%, dry heat contraction rates of the other yarns forming the fastener element attaching portion are in a range of 10 to 30%, and the dry heat contraction rate of the knitting yarns forming the foundation structure of the fastener tape main body portion is in a range of 3 to 10%. However, according to the heat contraction rates and other characteristics of material, materials other than the above thermoplastic synthetic resin material may be employed.

If the heat contraction rate of the monofilament is less than 3%, the elements are too stiff and the yarns can not easily bite into and form the recessed groove in a surface of the leg portion of each the element. Thus, the elements are liable to slip in the width direction of the tape. If the heat contraction rate is 18% or more, the elements are too soft and their coupling strength is decreased. Therefore, the elements are liable to slip in the width direction of the tape, and are easily separated from each other when the pushing up force is applied to the coupling portion. Such a slide fastener is not commercially practical because of its quality.

Further preferably, the fastener element row is made of polyamide, polyester, polybutylene, or polypropylene thermoplastic synthetic resin material. Specifically, nylon 6, nylon 66, polyester having a low drawing rate, or polybutylene terephthalate is preferable. The heat contraction rate of the monofilament which forms the fastener element row is selected from the contraction rate under dry heat and the contraction rate in boiling water according to the material. It is important to select the contraction rate such that the sufficient coupling strength can be obtained and simultaneously, the grooves can be formed by biting into of the yarns.

DESCRIPTION OF THE PREFERRED EMBODIMENTS

Figure 1:
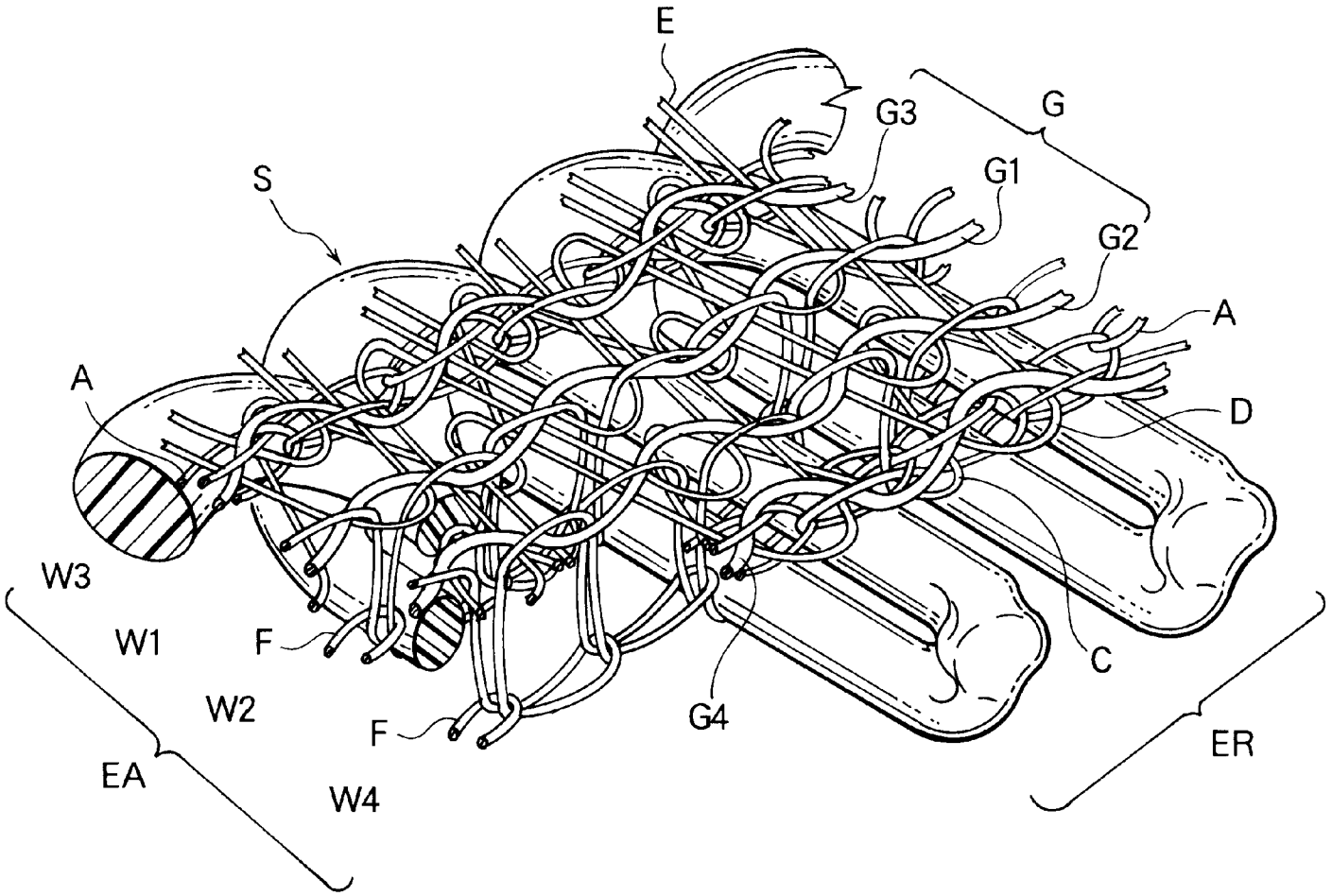
FIG. 1 schematically shows a first embodiment of the present invention and is a partial perspective view of a fastener element attaching portion of a knitted slide fastener seen from a rear side.
Figure 2:
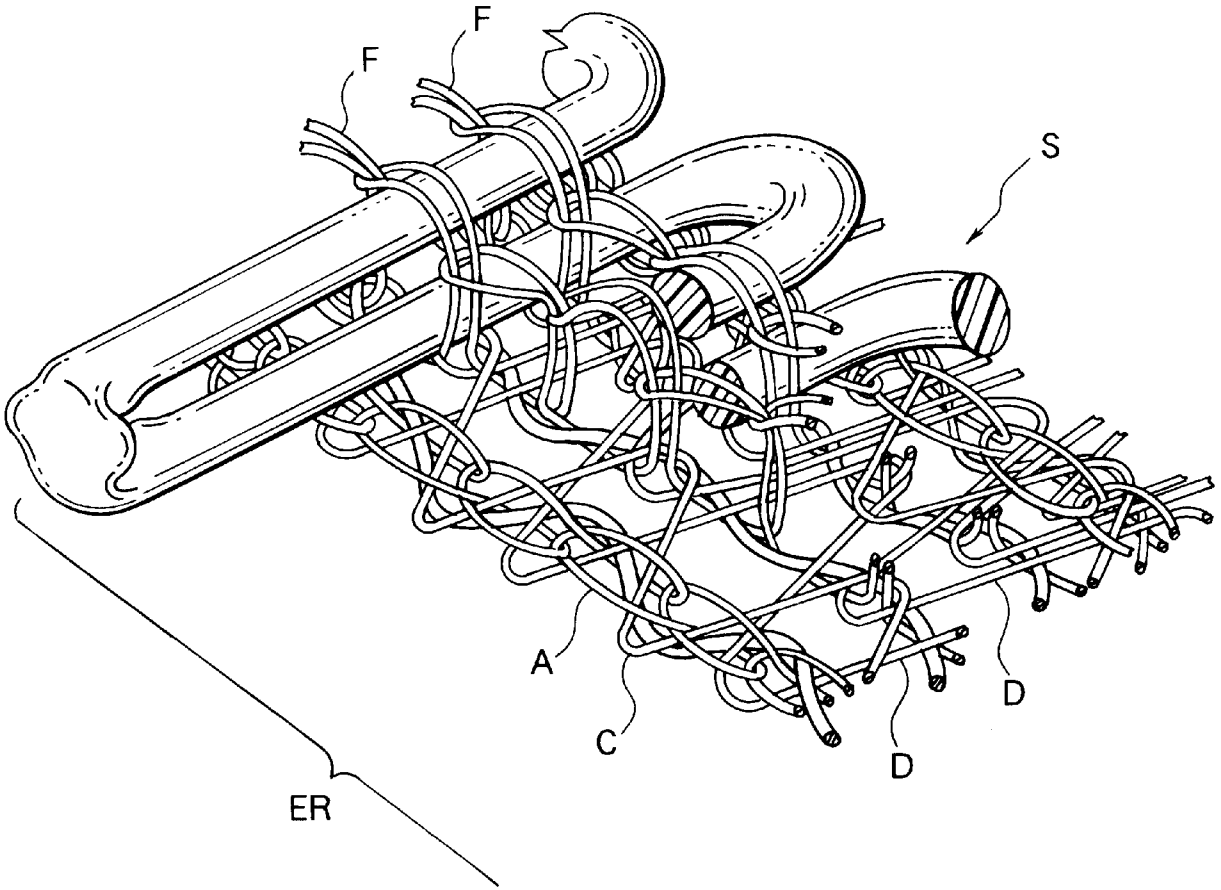
FIG. 2 is a partial perspective view of the fastener element attaching portion seen from a front side.
Figure 3:
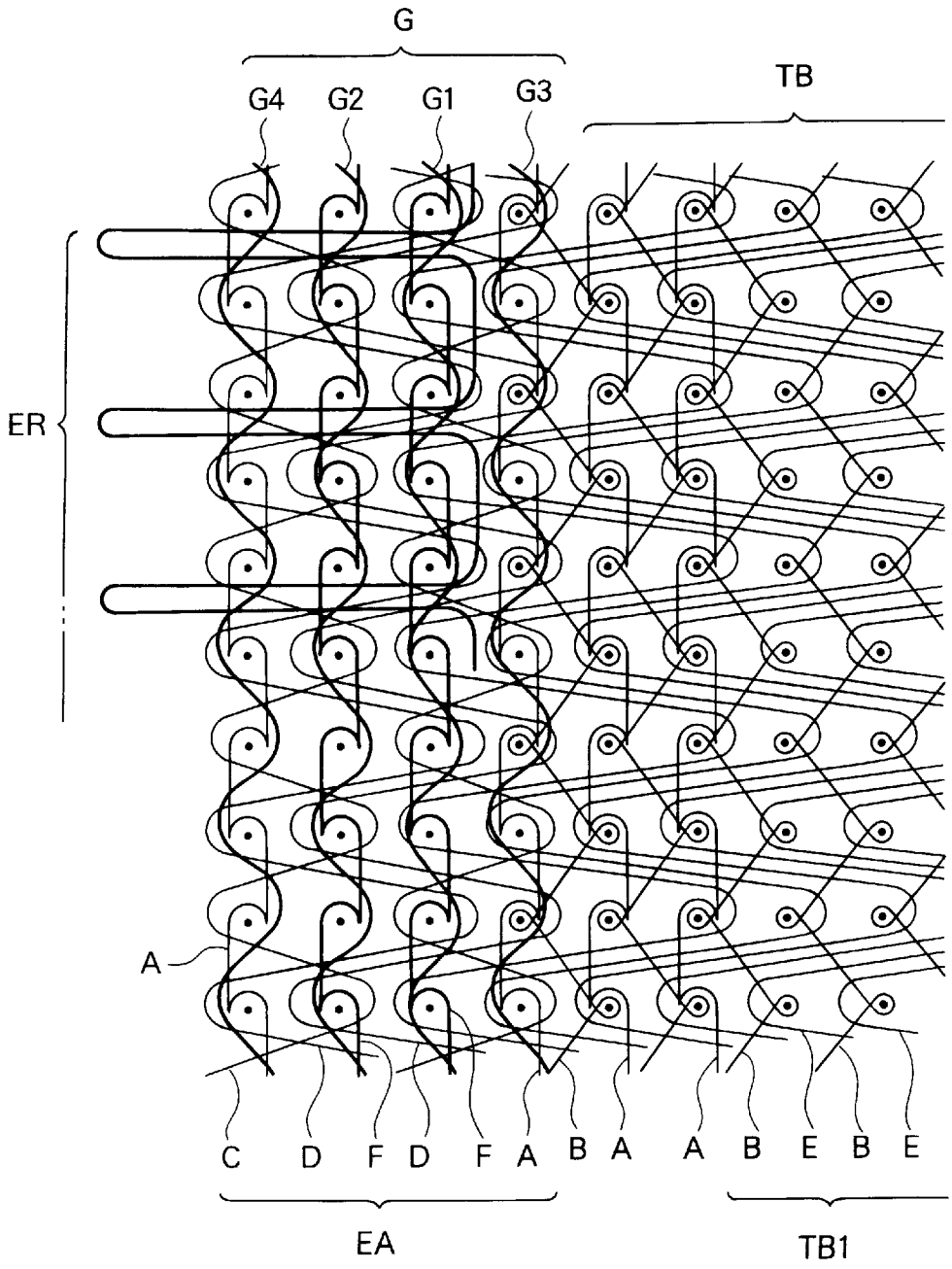
FIG. 3 shows an entire structure of the knitted slide fastener.
Figure 4:
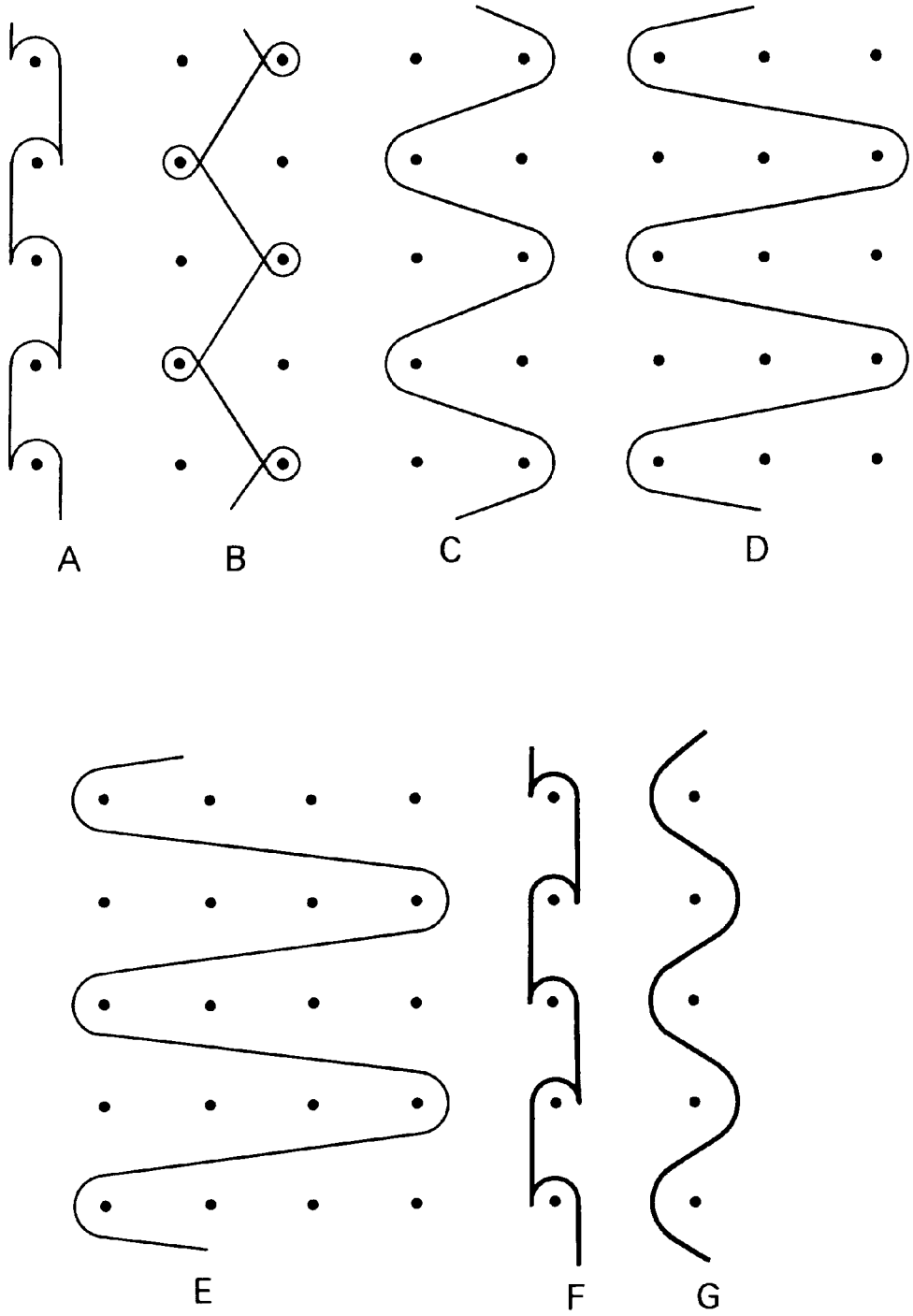
FIG. 4 shows a structure of each knitting yarn of the knitted slide fastener.

Preferred embodiments of the present invention will be specifically described below based on examples shown in the drawings. FIGS. 1 to 4 show a first embodiment of the present invention, wherein FIG. 1 schematically shows an attached successive fastener element row and is a perspective view of a part of a knitted slide fastener seen from a rear side, FIG. 2 is a perspective view of the part of the slide fastener seen from a front side, FIG. 3 shows an entire warp knitting structure of the slide fastener partly omitted, and FIG. 4 shows a warp knitting structure of each knitting yarn of the slide fastener.

In FIGS. 1 and 2, for better understanding, a fastener tape main body portion is omitted, but a fastener element attaching portion in a state where each knitting yarn is loosened is shown at a center. However, it will be understood that stitches and intermingled portions of each knitting yarn are finely tightened actually. The drawings show each knitting thread with various thickness to facilitate understanding, but the thickness can be arbitrarily chosen in accordance with a function of the knitted slide fastener and formation of the stitches. The above is true of respective embodiments shown in FIGS. 5 to 10 which will be described below.

As is understood from FIGS. 1 to 4, the knitted slide fastener S according to the first embodiment can be knitted by a general warp knitting machine having a single line of needle bed. This is true of respective modifications and other embodiments which will be described later.

A foundation structure of a fastener tape main body portion TB according to the present embodiment is formed with knitting yarns made of polyester synthetic fiber. As shown in FIGS. 3 and 4, a chain stitch yarn (A) is knitted into a chain stitch structure of 0-1/1-0 and a tricot knitting yarn (B) is knitted into a tricot knitting structure of 1-0/1-2. Three kinds of weft in-laid yarns (C), (D), and (E) are knitted into the same knitting structure of respective 0-0/2-2, 3-3/0-0, and 4-4/0-0 by being inserted in a zigzag shape and in a width direction of a fastener tape T. According to the present embodiment, because the chain stitch yarn (A) is omitted as shown in FIG. 3 at an intermediate position TB1 of the fastener tape main body portion TB, flexibility is provided to the intermediate position TB1 to easily fit an article such as clothes to which the fastener is mounted, and thus, the slide fastener S can be mounted easily and reliably. Of course, it is possible that the above chain stitch yarn (A) is not omitted but the intermediate position TB1 of the fastener tape main body portion TB may be knitted by using the chain stitch yarn (A) similarly to the other portions. The foundation structure of the fastener tape main body portion TB is not necessarily formed with the knitting yarns of polyester synthetic fiber but may be formed with knitting yarns of such as synthetic fiber yarns made of polyamide and/or polypropylene.

In the present embodiment, four wales at a longitudinal side edge portion of the fastener tape T is referred to as a fastener element attaching portion EA. A successive fastener element row ER is formed by reciprocating a monofilament for forming a coil-shaped fastener element row ER formed with the monofilament made of nylon 6 or nylon 66 in one course at every other course in the width direction of the tape and by knitting the monofilament into the attaching portion EA. The fastener element row ER is knitted into and successively mounted and fixed to the fastener element attaching portion EA by two wales of fixing chain stitch yarns (F) knitted into the same chain stitch structure of 0-1/1-0, at every other course simultaneously with forming of the coil-shaped fastener element row ER. The fixing chain stitch yarns (F) in this case are longitudinally knitted with their needle loops each extending over an upper side of a leg portion of each element E of the fastener element row ER, as shown in FIGS. 1 and 2. Each group of needle loops which extends in a direction of the wale fixes the fastener element row to the fastener element attaching portion EA by pushing the fastener element row from above toward the foundation structure. At this time, sinker loops form each group of sinker loops successively in the direction of the wale under the leg portions of the fastener element row ER, and form a part of the foundation structure of the fastener element attaching portion EA on which the fastener element row ER is disposed.

In the present embodiment, a warp in-laid yarn G1 is inserted while being intermingled in order with every sinker loop of each group of sinker loops of the fixing chain stitch yarns (F) under a knitting structure of 1-0/0-1 and is knitted into the foundation structure of the fastener element attaching portion EA. In the first embodiment, as especially shown in FIGS. 1 and 3, not only the warp in-laid yarns (G1, G2) are inserted in a zigzag shape along not only the fixing chain stitch threads (F) of two wales W1 and W2, but also warp in-laid yarns (G3, G4) are inserted along the chain stitch yarns (A) forming the wales W3 and W4 on opposite sides of the wales W1 and W2. Thus, a touch, appearance, and shape of fabric can be given to the entire foundation structure portion of the fastener element attaching portion EA, and sizes in the longitudinal and width directions can be stabilized, thereby fixing the fastener element row ER in a more stable state. The warp in-laid yarns (G1 to G4) may be inserted through only the chain stitch yarns (F) for fixing the fastener element row ER, or through respective chain stitch threads (F), (F), and (A) forming the three wales W1, W2, and W4 including an wale on an outmost edge of the fastener tape T. Therefore, the shown example shows only an example of the present embodiment, and it will be understood that the present embodiment includes various modifications.

In the above knitting structure, it is important that every knitting yarn for forming the fastener element attaching portion EA has a greater heat contractibility than at least the knitting yarns for forming the fastener tape main body TB in the present invention.

In other words, in the above first embodiment, the heat contraction rates of the warp in-laid yarns (G1) to (G4), the fixing chain stitch yarns (F), the chain stitch yarn (A) and the weft in-laid yarns (C) and (D) for forming the fastener element attaching portion EA are set at higher values than heat contraction rates of the chain stitch yarn (A), the tricot knitting yarn (B) and the weft in-laid yarn (E) for forming the fastener tape main body TB. The heat contraction rates of the warp in-laid yarns (G1) to (G4) are desirably set at higher values than heat contraction rates of the other yarns forming the fastener element attaching portion EA, i.e., the fixing chain stitch yarns (F), the chain stitch yarn (A) and the weft in-laid yarns (C) and (D).

This will be described by using specific values. Among the yarns forming the fastener element attaching portion EA, dry heat contraction rate of the warp in-laid yarns (G1) to (G4) of 100 to 150 deniers is in a range of 15 to 40% and preferably in a range of 20 to 30%, while dry heat contraction rates of the fixing chain stitch yarns (F), the chain stitch yarn A and the weft in-laid yarns (C) and (D) of 100 to 350 deniers is in a range of 10 to 30% and preferably in a range of 10 to 15%, and dry heat contraction rate of the chain stitch yarn (A), the tricot knitting yarn (B) and the weft in-laid yarn (E) forming the fastener tape main body portion TB of 100 to 300 deniers is in a range of 3 to 10% and preferably in a range of 5 to 8%.

The above contraction rates are determined by quality of material, drawing magnification in drawing, and set temperature of fiber or filament. In general, a yarn with a higher contraction rate has a lower drawing magnification, a lower set temperature, and a lower crystallization density, resulting in a lower strength and a larger extension rate. On the other hand, a normal yarn which is used generally and frequently has a higher drawing magnification, and is set in a strained state at a higher temperature, resulting in a higher crystallization degree, a higher strength and a lower contraction rate.

In the present invention, it is preferable that the heat contraction rates of the yarns for forming the fastener element attaching portion EA are set at higher values than the heat contraction rate of the monofilament which is the material for forming the fastener element row ER. Specifically, the heat contraction rate of the fastener element row ER of 0.4 to 0.8 mmϕ is in a range of 3 to 18%. The contraction rate can be a dry heat contraction rate or a boiling water contraction rate which vary depending on the quality of material. For example, in the present embodiment, a monofilament of nylon 66 is used whose dry heat contraction rate is preferably in a range of 7 to 11% and whose boiling water contraction rate is preferably in a range of 4 to 8% for a hardness of the elements and formation of grooves into which threads would bite.

On the other hand, if monofilament made of polyester is used, its dry heat contraction rate is preferably in a range of 16 to 18% and its boiling water contraction rate is preferably in a range of 6 to 10%. If monofilament made of polybutylene terephthalate is used, its dry heat contraction rate is in a range of 6 to 14% and its boiling water contraction rate is in a range of 2 to 5%, but if the boiling water contraction rate is less than 3%, the monofilament is too soft, thus a coupling strength is low, and an amount of biting into the elements by the yarns is too large, thereby decreasing a strength of the elements themselves. In view of the above, the heat contraction rate is chosen by the material, but is preferably in a range of 3 to 18%.

In the knitted slide fastener S having the fastener elements made of synthetic resin according to the present invention, by setting the above-mentioned relationship between respective heat contraction rates of the yarns forming the fastener element attaching portion EA, the yarns forming the fastener tape main boy portion TB, and the fastener element row ER, even if a knitting density is set at a normal value, the yarns forming the fastener element attaching portion EA contract more largely than the yarns forming the fastener tape main body portion TB, by application of a heat treatment after knitting. As a result, the knitting density of the fastener element attaching portion EA is increased and the portion EA is made fine. Thus, the shape of the tape is further stabilized in addition to that the touch and appearance of fabric is given to the knitting structure, as described above. Because the fastener element row ER is further firmly strained and fastened by the fixing chain stitch yarns (F), the elements are not separated from each other when the fastener stringer is bent largely toward the tape face, thereby ensuring a high coupling strength.

Figure 5:
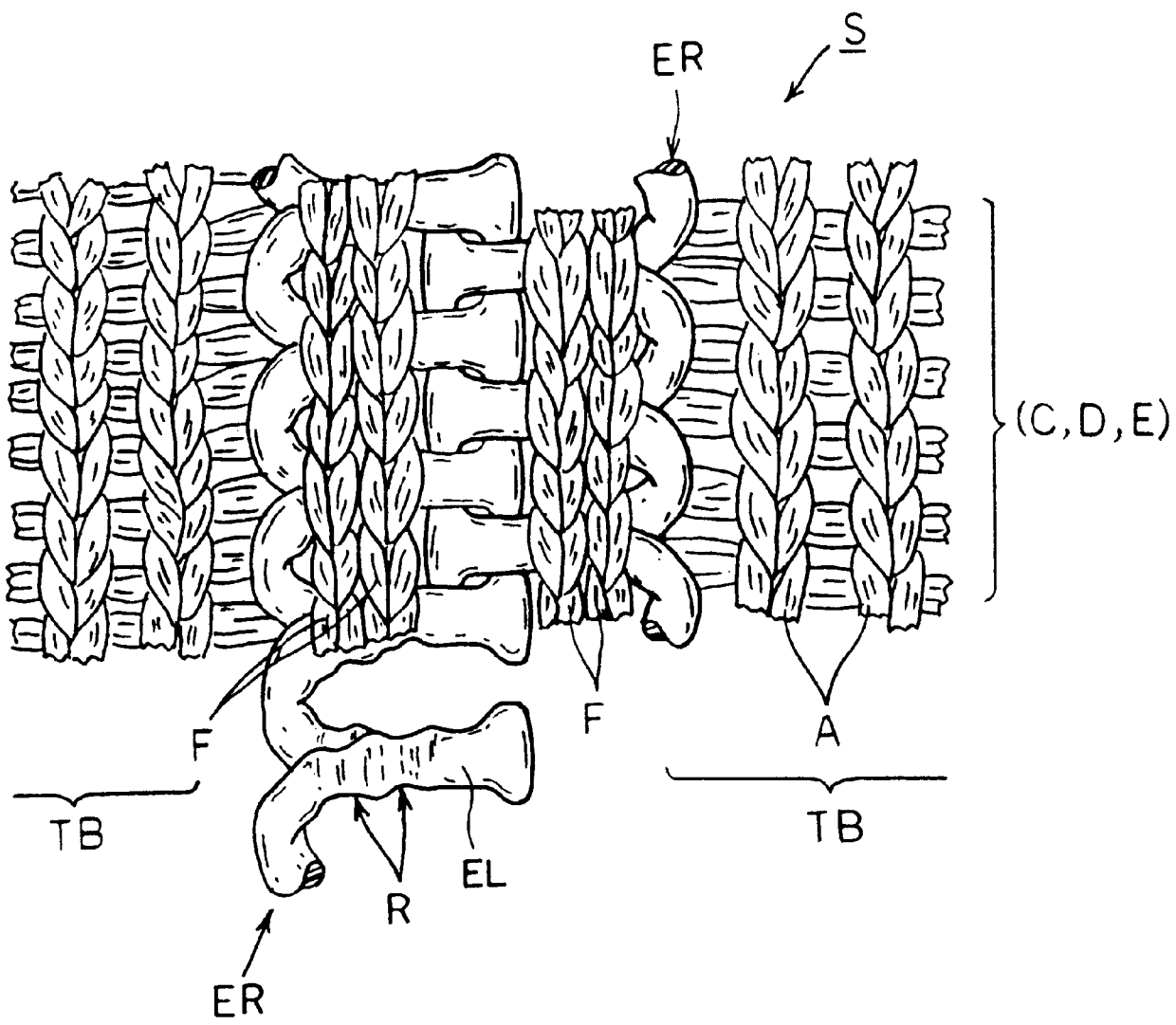
FIG. 5 is a partial plan view which schematically shows the knitted slide fastener with a part of the yarns cut off.

At this time, if the heat contraction rate of the warp in-laid yarns (G1) to (G4) is set at a higher value than the heat contraction rates of the other yarns forming the fastener element attaching portion EA, i.e., the fixing chain stitch yarns (F), the chain stitch yarn (A) and the weft in-laid yarns (C) and (D), and the heat contraction rates of all the yarns forming the fastener element attaching portion EA are set at higher values than the heat contraction rate of the fastener element row ER, the shape of the fastener stringer can be further stabilized. Also, due to contraction of the fixing chain stitch yarns (F) as well as contraction of the monofilament which constitutes the fastener elements E, leg portions EL of the fastener element row ER are strained and fastened by the fixing chain stitch yarns (F) and partially deformed to have recessed grooves, as shown in FIG. 5. Therefore, the straining and fastening force is increased and simultaneously, the fastener element row ER is not displaced in the longitudinal direction or the width direction.

Moreover, because the fastener element row ER is knitted into the fastener stringer which is a knitted product in general, a length of the element attaching portion EA is made larger than a length of the tape body T. As a result, the entire fastener stringer is in such a shape that the element row ER is curved outward in a bow shape to project outward. However, because the element attaching portion EA contracts more largely than the tape main body portion TB through the heat contraction treatment, the fastener stringer is formed into a substantially straight shape or a shape with the element row slightly curved inward in a recessed shape.

Figure 6:
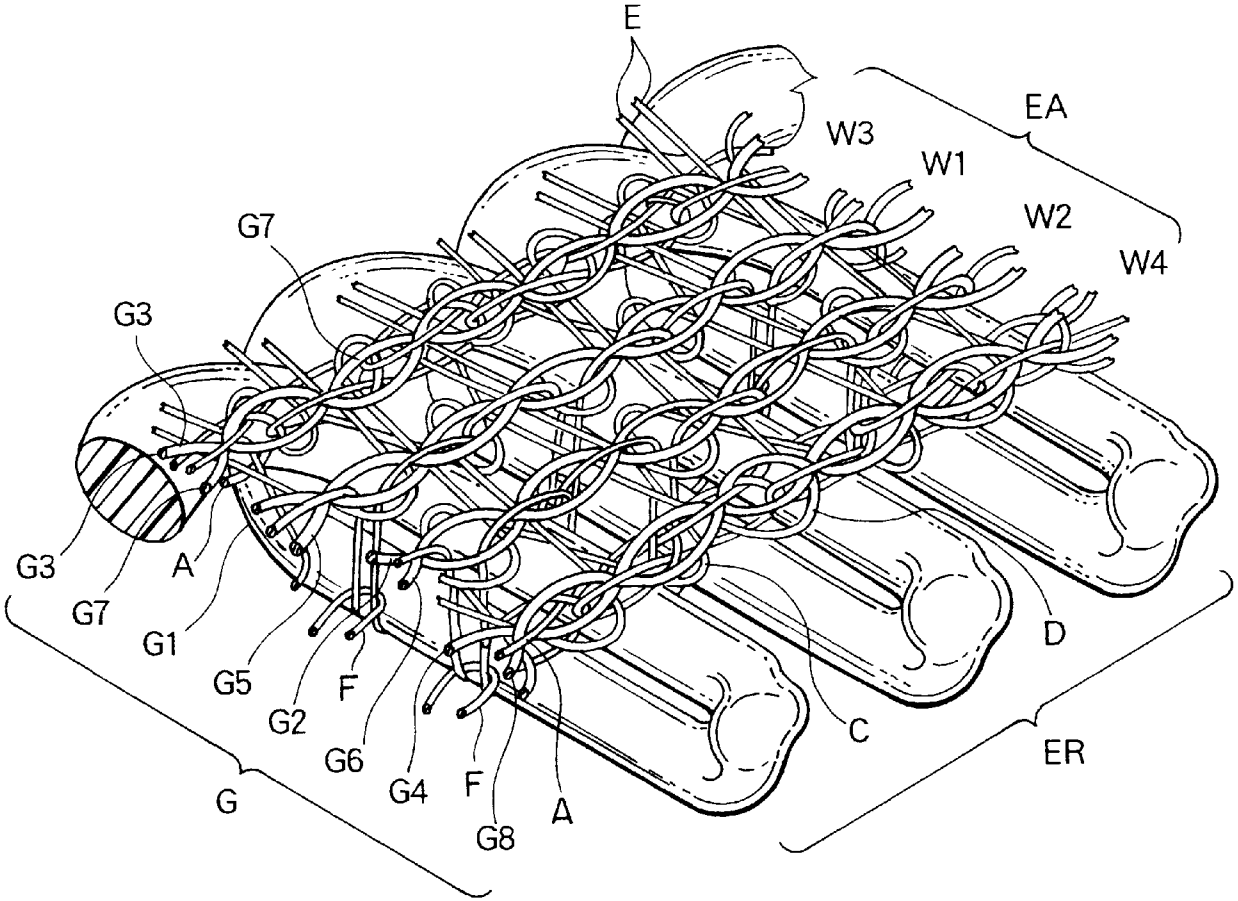
FIG. 6 schematically shows a second embodiment and is a partial perspective view of a fastener element attaching portion of a knitted slide fastener seen from a rear side.

FIG. 6 shows a second embodiment of the present invention and is a perspective view of a part of a slide fastener seen from a rear side, schematically showing an attached coil-shaped fastener element row ER. In this embodiment, knitting structures of respective knitting yarns except for warp in-laid yarns (G1 to G8) are similar to those in the first embodiment. Two warp in-laid yarns (G1, G5; G2, G6) are inserted through sinker loop groups of respective two wales (W1, W2) of fixing chain stitch yarns for fixing the coil-shaped fastener element row ER, while being crossed and intermingled with each other symmetrically at every sinker loop. Respective warp in-laid yarns (G3, G7; G4, G8) are inserted through respective wales W3 and W4 of chain stitch yarns (A) which is a part of yarns forming the foundation structure on opposite sides of the wales W1 and W2, in addition to the warp in-laid yarns (G1, G5; G2, G6) inserted through the two fixing chain stitch yarns (F) in the shown example. However, the warp in-laid yarns (G3, G7; G4, G8) are not necessarily inserted through the sinker loop groups of the chain stitch yarns (A). And alternatively, the warp in-laid yarns (G1, G5; G2, G6; G4, G8) may be inserted through the chain stitch structure of the two fixing chain stitch yarns (F) and a warp knitting structure of a chain stitch yarn (A) at an outmost edge portion, and weft in-laid yarns (C) and (D), respectively.

Figure 7:
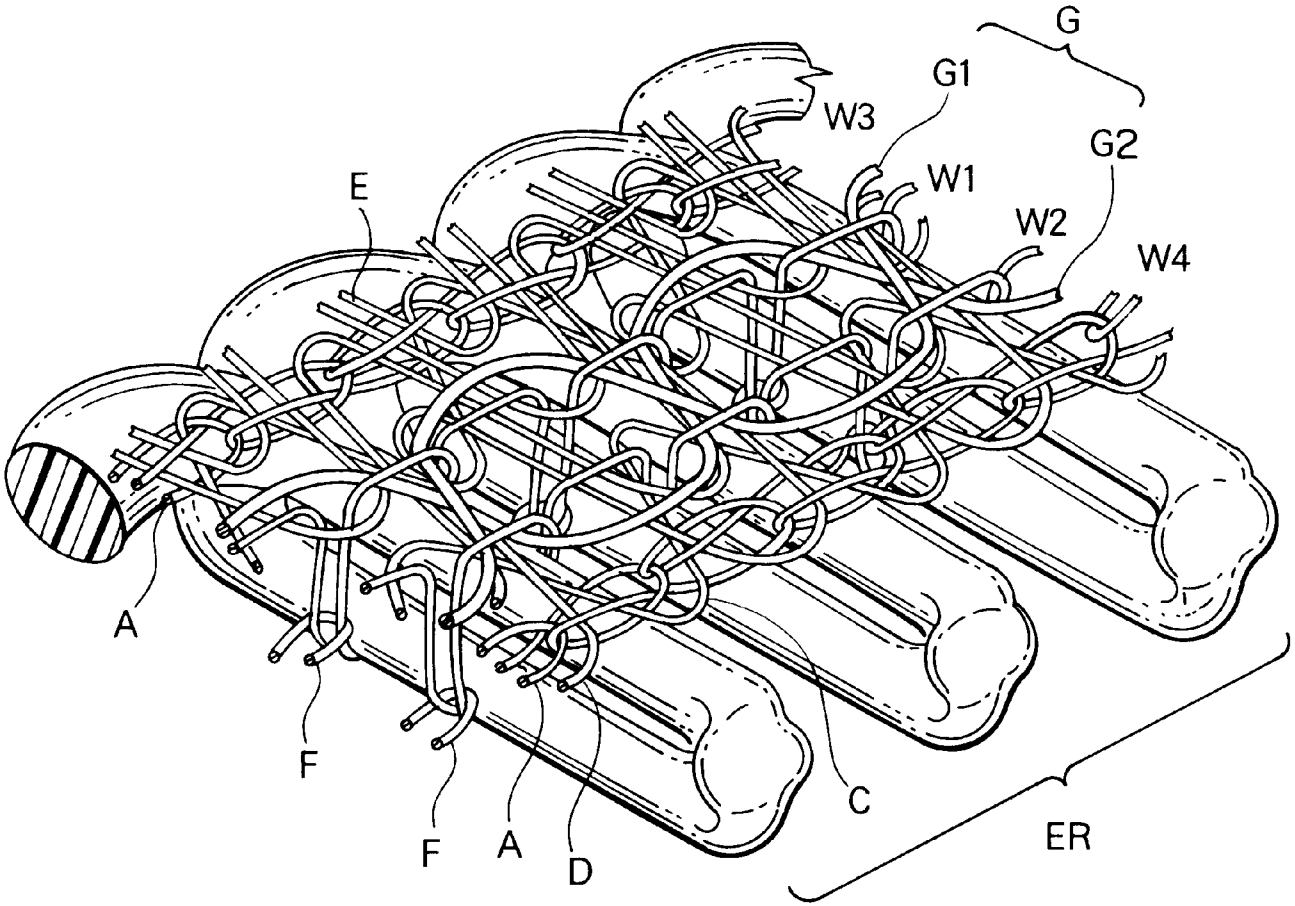
FIG. 7 schematically shows a third embodiment and is a partial perspective view of a fastener element attaching portion of a knitted slide fastener seen from a rear side.

FIG. 7 shows a third embodiment of the present invention, and is a perspective view of a part of a slide fastener seen from a rear side, schematically showing an attached coil-shaped fastener element row ER. In this embodiment also, knitting structures of respective knitting yarns except for insertion states of the warp in-laid yarns (G1, G2) are similar to those in the first embodiment. In the present embodiment, two warp in-laid yarns (G1, G2) are inserted to extend over two lines of sinker loop groups formed by fixing chain stitch yarns (F) of two wales W1 and W2 which fix the coil-shaped fastener element row ER, and are crossed and intermingled with each other in a zigzag shape symmetrically at every other sinker loop, as shown in FIG. 7.

Figure 8:
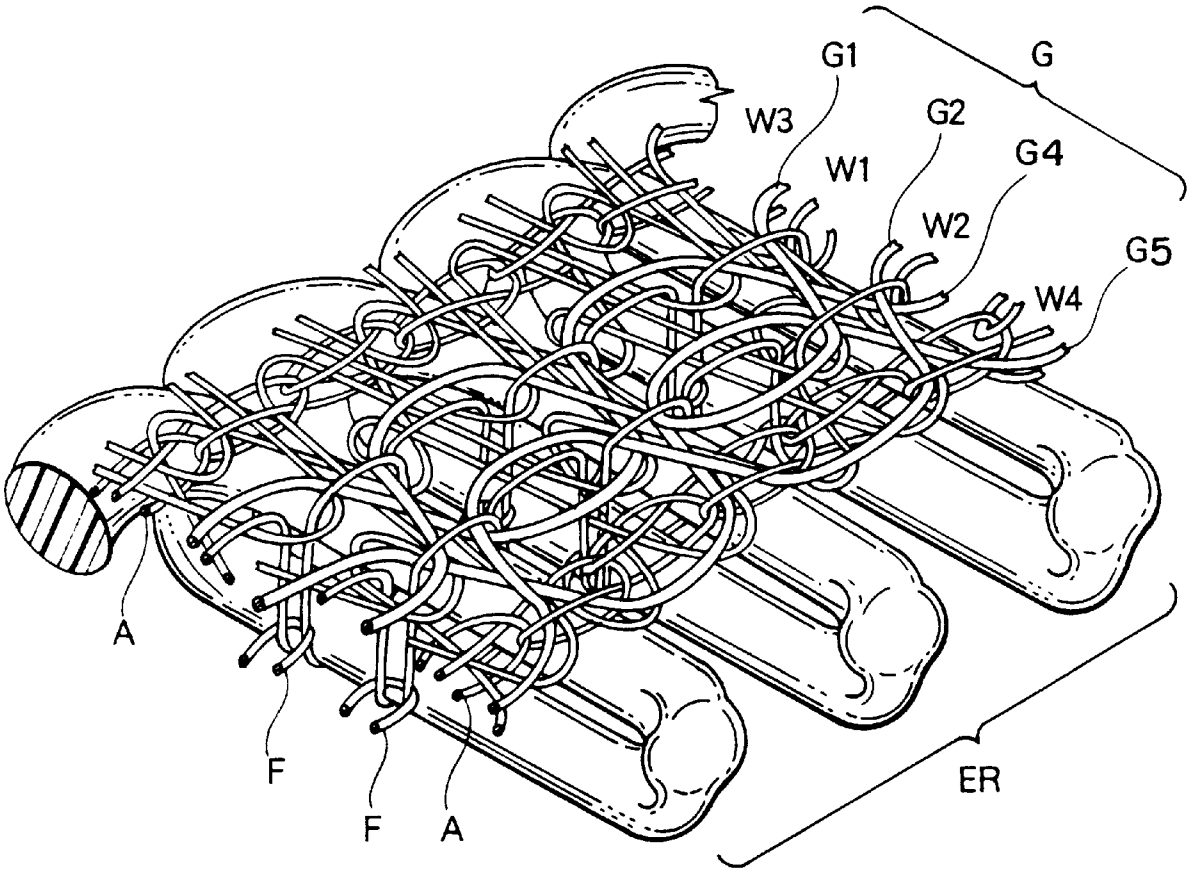
FIG. 8 schematically shows a fourth embodiment and is a partial perspective view of a fastener element attaching portion of a knitted slide fastener seen from a rear side.

FIG. 8 is a similar perspective view showing a fourth embodiment of the present invention. In the present embodiment, in addition to the structure of the above third embodiment, two warp in-laid yarns (G2, G5) are inserted to extend over a sinker loop group of a chain stitch yarn (A) of an wale W3 at an outmost edge and a sinker loop group of a fixing chain stitch yarn (F) adjacent to said sinker loop group, and are crossed and intermingled with each other in a zigzag shape symmetrically at every other sinker loop, as shown in FIG. 8.

Figure 9:
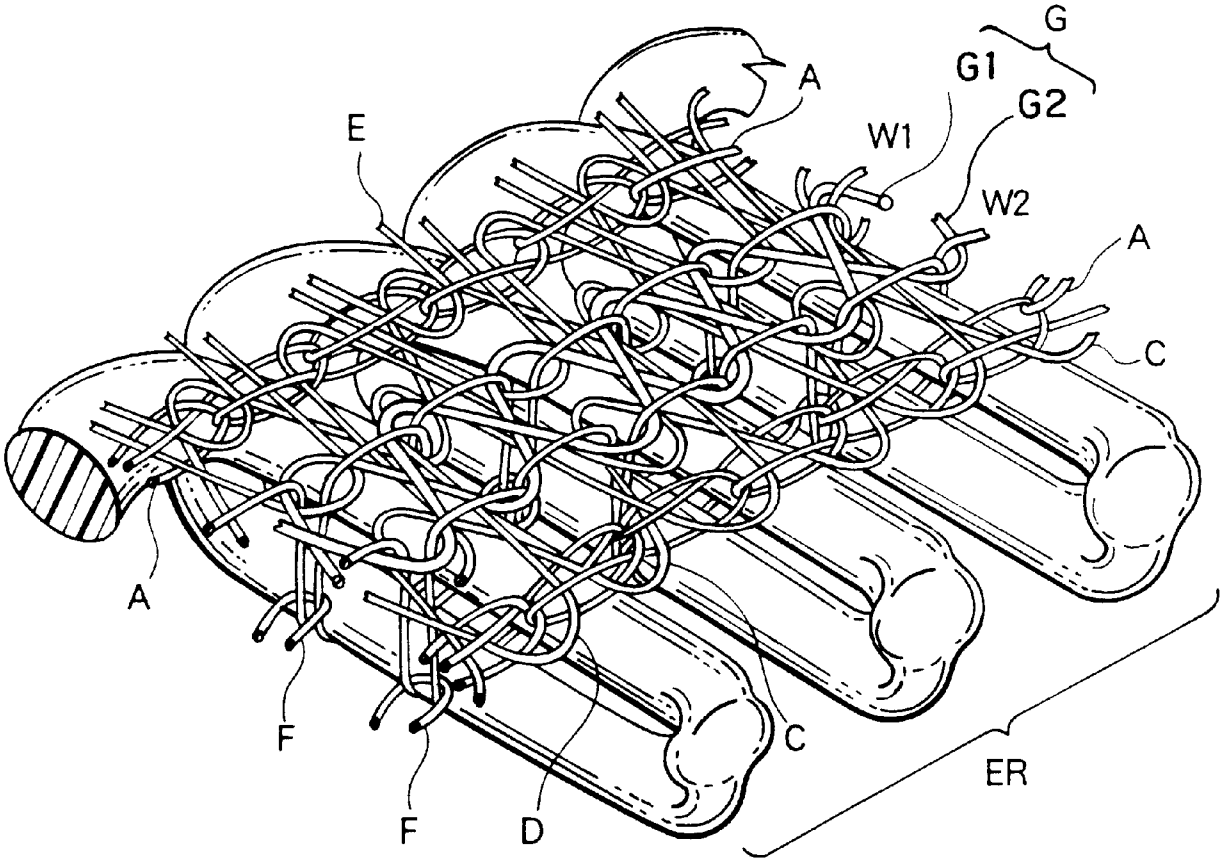
FIG. 9 schematically shows a fifth embodiment and is a partial perspective view of a fastener element attaching portion of a knitted slide fastener seen from a rear side.

FIG. 9 shows a fifth embodiment which is similar to the above third embodiment in that two warp in-laid yarns (G1, G2) are used. In the present embodiment, however, the two warp in-laid yarns are inserted to extend over respective sinker loop groups formed in directions of two wales W1 and W2 of the fixing chain stitch yarns (F), and are crossed and intermingled with each other in a zigzag shape symmetrically between all the sinker loops.

Figure 10:
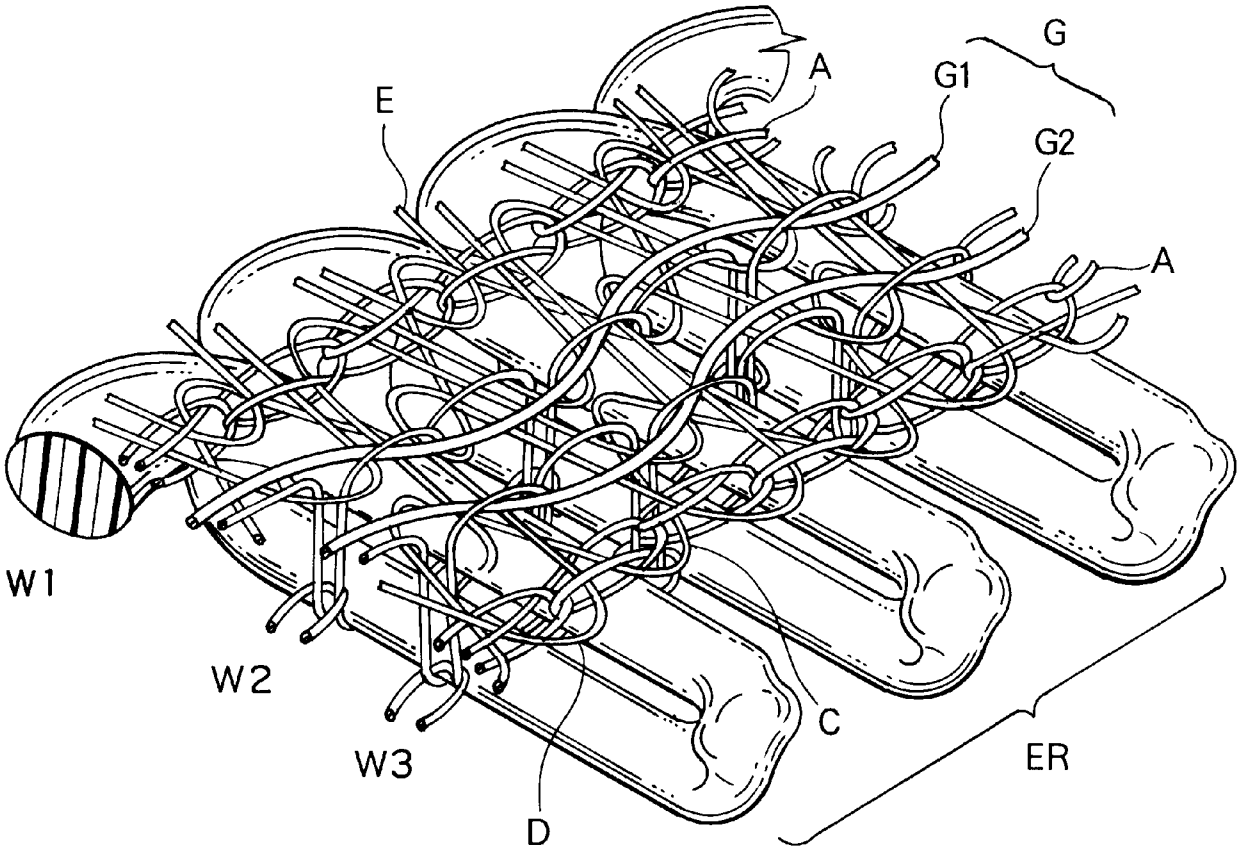
FIG. 10 schematically shows a sixth embodiment and is a partial perspective view of a fastener element attaching portion of a knitted slide fastener seen from a rear side.

FIG. 10 shows a sixth embodiment of the present invention which is similar to the above first embodiment in that a warp in-laid yarn (G1, G2) is inserted through each sinker loop group of the two lines of fixing chain stitch yarns (F). In the present embodiment, however, each warp in-laid yarn (G1, G2) is intermingled in order with each sinker loop group at every other sinker loop. FIG. 10 shows the example wherein each the warp in-laid yarn (G) is inserted through the sinker loop group of each fixing chain stitch yarn (F) of two wales W1 and W2, but warp in-laid yarns may be inserted similarly through two chain stitch yarns (A) forming a part of the foundation structure adjacent to the respective fixing chain stitch yarns (F) or a chain stitch yarn (A) of an wale W3 at an outmost edge.

Figure 11:
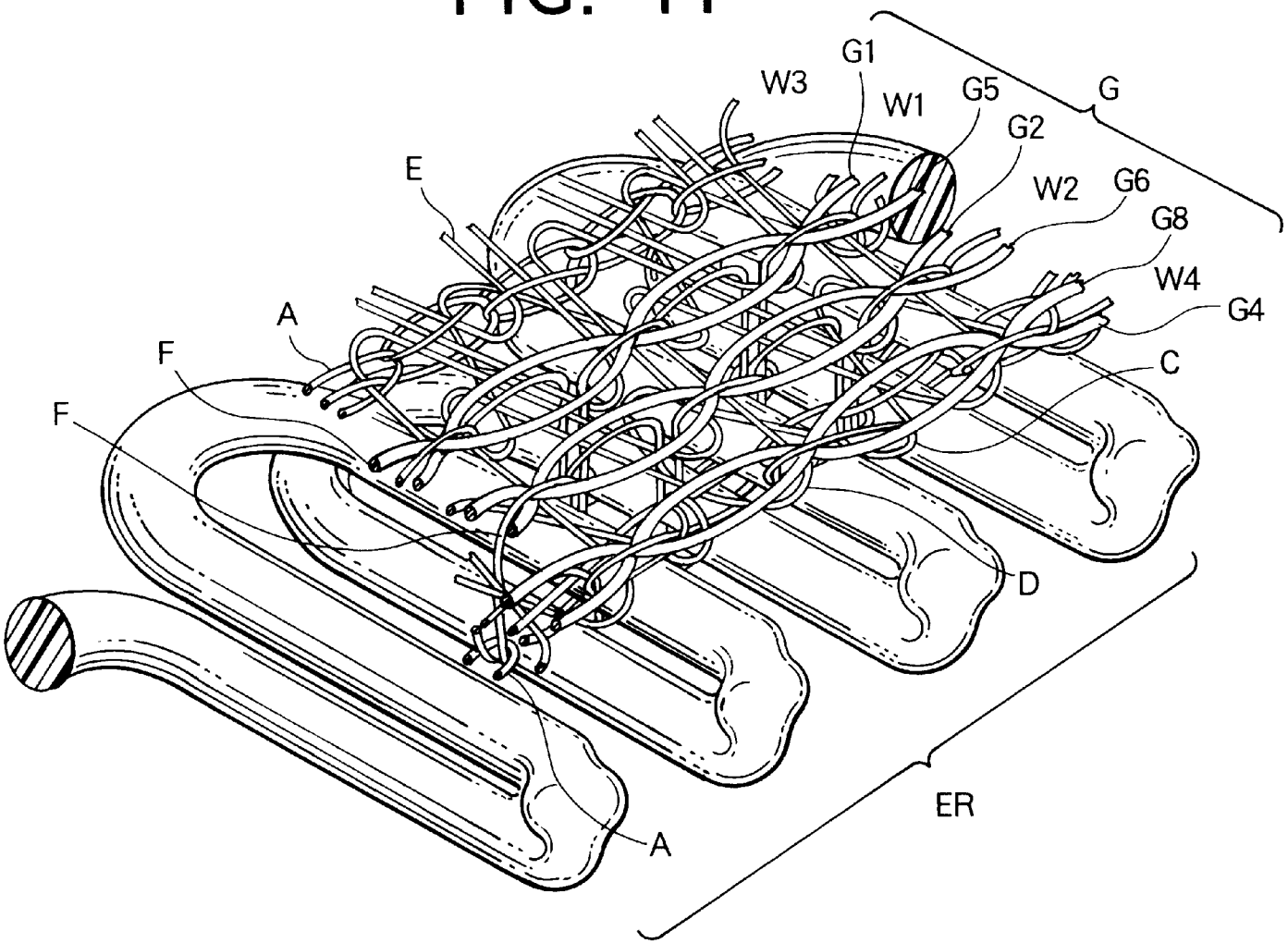
FIG. 11 schematically shows a seventh embodiment and is a partial perspective view of a fastener element attaching portion of a knitted slide fastener seen from a rear side.

FIG. 11 shows a seventh embodiment which is similar to the above second embodiment in that two warp in-laid yarns (G1, G5; G2; B6) are inserted through each sinker loop group of two lines of fixing chain stitch yarns (F). In the present embodiment, however, two warp in-laid yarns (G1, G5; G2; G6) are inserted through a line of sinker loop group and are intermingled with each other symmetrically at every other sinker loop formed in the group. The warp in-laid yarns (G4, G8) are inserted through a sinker loop group of a chain stitch yarn (A) at an outmost edge, in addition to the sinker loop groups of each fixing chain stitch yarn (F) of two wales W1 and W2 in the present embodiment, but the warp in-laid yarn (G) inserted through the sinker loop group of the chain stitch yarn (A) at the outmost edge may be omitted, or the warp in-laid yarns (G3, G7) may be inserted through the sinker loop group of the chain stitch yarn (A) adjacent to the fixing chain stitch yarn (F) on an opposite side from the outmost edge.

In the second to seventh embodiments, similarly to the first embodiment, all the knitting yarns forming the fastener element attaching portion EA have heat contraction rates which are higher than at least those of the knitting yarns forming the fastener tape main body portion TB. Also, the heat contraction rate of the fastener element row ER is lower than the heat contraction rates of the other yarns forming the tape. At the same time, the heat contraction rate of the warp in-laid yarns (G1 to G8) is set at higher values than those of the other knitting yarns. As a result, functions which are similar to those of the above-described first embodiment can be obtained by the above structures in addition to functions based on the knitting structures.

The various embodiment have been described above, but it is apparent from the above description that the present invention is not limited to the embodiments. For example, a thickness of each knitting yarn forming the foundation structure in each of the above embodiment can be arbitrarily chosen if necessary, as mentioned above, and a thickness of each of the above warp in-laid yarn (G) can be also chosen arbitrarily. Particularly, in the above respective embodiments, a thickness of a warp in-laid yarn (G) inserted through a chain stitch yarn (A) disposed closest to coupling heads of the fastener elements may be larger than a thickness of a warp in-laid yarn (G) inserted through a fixing chain stitch yarn (F) disposed inwardly adjacent to the above chain stitch yarn. In this case, an end edge portion of the fastener element attaching portion becomes thick, and can be fully resistant to bending or pushing up of the fastener face, thereby suppressing the separation of the fastener elements to a minimum.

The knitting structure of each the knitting yarn forming the foundation structure of the fastener tape main body portion TB other than the knitting structures of the chain stitch yarns (F) for fixing the fastener element row ER is not limited to the shown structure. The weft in-laid yarns are formed in three kinds of structures in the above examples but may be inserted in the same structure.

The fixing chain stitch yarns (F) form two wales in the above embodiments, but may form three wales according to a size of the fastener element row. In such a case, the warp in-laid yarns (G) are inserted through all the fixing chain stitch yarns (F) while being intermingled with each other. Furthermore, the above successive fastener element row is not limited to a coil-shaped fastener element row but may be a so-called zigzag-type fastener element row wherein the monofilament continues along a longitudinal direction to have right and left leg portions and connecting portions curved in a U shape on a flat face of the fastener tape main body portion TB, while extending alternately upward and downward with coupling heads formed therebetween, as shown in FIG. 11.

Moreover, the present invention can be applied to a concealed slide fastener which is mounted on an article with coupling portions and connecting portions opposite from the coupling portions of the successive fastener element row ER which are made of plastic monofilament being formed at reverse positions. Then, after the attachment of the fastener element row is completed, the fastener element attaching portion is folded back such that the coupling portions are coupled to each other.

As specifically described above, the heat contraction rates of at least all the knitting yarns forming the fastener element attaching portion are set at larger values than the heat contraction rates of the knitting yarns forming the tape main body portion. Therefore, through the heat treatment after the knitting, all the knitting yarns forming the fastener element attaching portion contract more largely than the knitting yarns forming the tape main body portion, such that irregularity of pitches of fastener elements knitted on the foundation structure of the fastener element attaching portion are not easily caused. Because the fixing yarns bite into strained and fastened portions of the leg portions of the fastener element row to form the recessed grooves, knitting yarns disposed on and under the leg portions of the fastener elements easily balance with each other and fastening forces of the knitting yarns become strong. Further, a strong resistance to the bending stress pushing up the fastener face is applied to the fastener stringer, thereby preventing separation of the fastener elements due to rising of the coupled portions of the elements, and a closing function of the slide fastener can be ensured constantly.

In a case where the heat contraction rate of the warp in-laid yarns is higher than those of all the other knitting yarns and the heat contraction rate of the fastener element row is lower than those of the knitting yarns forming the tape in the present invention, in addition to the above effects, the fixing knitting yarns deform the respective leg portions of the fastener elements to have the recessed grooves. Therefore, the fastener elements are not displaced due to use of the slide fastener on any conditions, and the fastening force can be further increased. The fastener elements project outward in a bow shape, which is inevitable in this type of knitted slide fastener, but the fastener stringer becomes substantially straight or the fastener element row slightly curves inward in a recessed shape, after the heat treatment. As a result, the fastener stringer can be treated easily in the succeeding fastener producing steps, and can be treated extremely easily in the later sewing steps to allow an automatic sewing.

What is claimed is:

1. A knitted slide fastener comprising a successive fastener element row fixed by at least a fixing knitting yarn, the fastener element row being knitted, simultaneously with knitting of a fastener tape, into a fastener element attaching portion at a longitudinal side edge portion of the fastener tape formed of a warp-knit foundation structure, wherein the foundation structure of the fastener element attaching portion is formed of at least a part of the fixing knitting yarn, and all of the knitting yarns forming the fastener element attaching portion have heat contraction rates higher than at least that of knitting yarns forming a foundation structure of a fastener tape main body portion.

2. A knitted slide fastener according to claim 1, wherein the heat contraction rates of the knitting yarns forming the fastener element attaching portion are higher than that of a monofilament forming the fastener element row.

3. A knitted slide fastener according to claim 1 or 2, wherein a heat contraction rate of a warp in-laid yarns which constitutes the fastener element attaching portion is higher than that of the other yarns forming the fastener element attaching portion.

4. A knitted slide fastener according to any one of claims 1 to 3, wherein the fastener element row is made of thermoplastic synthetic resin, and the heat contraction rate of the monofilament which is a material forming the fastener element row is in a range of 3 to 18%, a dry heat contraction rate of the warp in-laid yarn which forms the fastener tape is in a range of 15 to 40%, dry heat contraction rates of the other yarns forming the fastener element attaching portion are in a range of 10 to 30%, and a dry heat contraction rate of the yarn forming the fastener tape main body portion is in a range of 3 to 10%.

5. A knitted slide fastener according to claim 4, wherein the fastener element row is made of polyamide synthetic resin, polyester synthetic resin, polybutylene synthetic resin, or polypropylene synthetic resin, the heat contraction rates are selected from a dry heat contraction rate and a boiling water contraction rate and are set at values so as to cause the respective forming yarns to bite into and form grooves in leg portions of the monofilament as a result of contraction of the warp in-laid yarn, the other yarns forming the fastener element attaching portion, and the monofilament forming the fastener element row at the time of heat contraction of the fastener tape.

* * * * *